US009759501B2

(12) United States Patent
Michlin

(10) Patent No.: US 9,759,501 B2
(45) Date of Patent: Sep. 12, 2017

(54) BREECH ASSEMBLY

(71) Applicant: U.S. Army Research Laboratory, Washington, DC (US)

(72) Inventor: Alexander E. Michlin, Whiteford, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/050,756

(22) Filed: Feb. 23, 2016

(65) Prior Publication Data

US 2017/0074609 A1 Mar. 16, 2017

Related U.S. Application Data

(60) Provisional application No. 62/216,388, filed on Sep. 10, 2015.

(51) Int. Cl.

| | |
|---|---|
| ***F41A 3/14*** | (2006.01) |
| ***F41A 3/16*** | (2006.01) |
| ***F41A 3/30*** | (2006.01) |
| ***F41A 3/46*** | (2006.01) |
| ***F41A 21/48*** | (2006.01) |

(52) U.S. Cl.

CPC ..... *F41A 3/46* (2013.01); *F41A 21/482* (2013.01)

(58) Field of Classification Search

CPC ..... F41A 3/12; F41A 3/14; F41A 3/16; F41A 3/26; F41A 3/30; F41A 3/36; F41A 3/44; F41A 3/46; F41A 3/70

USPC ..... 42/14, 19; 89/185, 17, 19, 18, 20.2

See application file for complete search history.

(56) References Cited

U.S. PATENT DOCUMENTS

| | | | | | |
|---|---|---|---|---|---|
| 1,336,093 | A | * | 4/1920 | Schneider | F41A 3/08 89/20.2 |
| 1,359,045 | A | * | 11/1920 | Fisher | F41A 3/26 123/183.1 |
| 1,424,773 | A | * | 8/1922 | Payne | F41A 3/26 42/16 |
| 1,637,233 | A | * | 7/1927 | Norman | F41A 3/20 89/153 |
| 1,648,833 | A | * | 11/1927 | Vincon | F41A 3/26 89/181 |
| 1,860,157 | A | * | 5/1932 | Payne | F41A 3/26 42/25 |
| 2,675,638 | A | * | 4/1954 | Crittendon | F41A 19/45 42/69.01 |
| 2,685,754 | A | * | 8/1954 | Crittendon | F41A 3/26 42/16 |

(Continued)

*Primary Examiner* — Derrick Morgan
(74) *Attorney, Agent, or Firm* — Alan I. Kalb

(57) ABSTRACT

A breech assembly for an automatic weapon having a barrel extension aligned with and extending outwardly from the rifle bore. The barrel extension has a throughbore aligned with the rifle bore and a non-circular locking recess at a rear end of fee barrel extension. The barrel extension also includes an internal thread in the throughbore. An elongated bolt includes an external thread complementary to the infernal thread hi the barrel extension. The bolt is mounted to a bolt carrier that is longitudinally slidably mounted to the gun body. Longitudinal movement of the bolt carrier simultaneously longitudinally and rotatably drives the bolt so that the bolt thread is threaded into the barrel extension.

3 Claims, 2 Drawing Sheets

(56) References Cited

U.S. PATENT DOCUMENTS

| | | | | | |
|---|---|---|---|---|---|
| 2,717,535 | A * | 9/1955 | Taylor | F41A 3/26 | 42/16 |
| 3,030,722 | A * | 4/1962 | Ivy | F41A 3/16 | 42/16 |
| 3,377,730 | A * | 4/1968 | Lewis | F41A 3/18 | 42/16 |
| 4,389,919 | A * | 6/1983 | Kast | F41A 19/02 | 89/185 |
| 4,402,152 | A * | 9/1983 | Casull | F41A 15/14 | 42/16 |
| 9,347,738 | B1 * | 5/2016 | Schumacher | F41A 3/26 | |
| 2010/0005956 | A1 * | 1/2010 | Wossner | F41A 21/484 | 89/188 |
| 2010/0281734 | A1 * | 11/2010 | Rousseau | F41A 15/14 | 42/25 |
| 2014/0251118 | A1 * | 9/2014 | Moretti | F41A 3/20 | 89/23 |

* cited by examiner

BREECH ASSEMBLY

GOVERNMENT INTEREST

The invention described herein may be manufactured, used, and licensed by or for the United States Government.

BACKGROUND OF THE INVENTION

I. Field of the Invention

The present invention relates generally to firearms and, more particularly, to a breech assembly for a semiautomatic or automatic weapon.

II. Description of Related Art

There are many automatic and semi automatic small arm rifles that are used both in military applications as well as for civilian use. These previously known automatic and semi-automatic weapons include a bolt which reciprocates between a loading position and a firing position for each shot that is fired. In its loading position, the bolt is retracted from the barrel which both ejects the casing from the previously fired cartridge and also allows a new cartridge to be loaded from an ammunition magazine into a load chamber behind the gun breech.

The subsequent forward movement of the bolt to its firing position loads the cartridge into the breech and the bolt is then looked into position. Upon firing of the shot, the bolt supports the full load from the firing of the cartridge. After the cartridge has been fired, the bolt unlocks and moves to its retracted or loading position in which the casing is ejected, a new cartridge is loaded into the load chamber behind the breech, and the above process is repeated.

Most of today's automatic and semiautomatic rifles use a locking lug style breech to lock the bolt to the rifle when it is fired. In a locking lug style breech, the bolt includes a plurality of radial protrusions. These protrusions pass through mating protrusions on the barrel extension and the locking lugs and the bolt are then rotated to align with the protrusions on the barrel extension. Given this geometry, however, the locking lugs can have no more than a 50% load bearing support with the rifle when fired. This, in turn, requires that the bolt as well as the protrusions in the barrel or barrel extension of the rifle have a relatively large minimum size in order to adequately support the load when the rifle is fired.

SUMMARY OF THE PRESENT INVENTION

The present invention provides a breech assembly particularly suited for automatic and semiautomatic guns which overcomes the disadvantages of the previously known breech assemblies.

In brief, the breech assembly of the present invention includes a barrel extension which is aligned with and extends outwardly from the rear end of the gun barrel. The barrel extension includes a throughbore aligned with the gun bore as well as a non-circular locking recess at the rear end of the barrel extension. The barrel extension also includes an internal thread within its throughbore.

An elongated bolt is provided and has an external thread complementary to the internal thread in the throughbore in the barrel extension. The bolt is longitudinally movable between a retracted or loading position and an extended or firing position. In its loading position the bolt is retracted from the barrel extension to eject the spent casing and also to receive a new cartridge in preparation for loading the cartridge into the breech for firing. Conversely, in its firing position the bolt extends into the barrel extension and loads the cartridge into the breech as well as supports the firing load from the cartridge.

Although different means may be used to rotatably drive the bolt both into and out from threaded engagement with the barrel extension, in the preferred embodiment a bolt carrier is disposed around the bolt and is longitudinally slidably mounted to the gun body and locked against rotation to the gun body. The bolt carrier also includes a locking member at one end that is complementary in shape to the locking recess termed in the barrel extension. A spiral thread is also formed in the bolt carrier while a cam pin, which is attached to the bolt extends through the spiral thread.

In operation, the coaction between the cam pin and the spiral thread in the bolt carrier causes the bolt to rotate during longitudinal movement of the bolt carrier and bolt. Furthermore, the locking member attached to the from end of the bolt carrier nests within the locking recess in the barrel extension when the bolt is moved to its thing position. This locking member thus prevents further rotation of the bolt until the locking member is physically withdrawn from the locking recess is the barrel extension.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
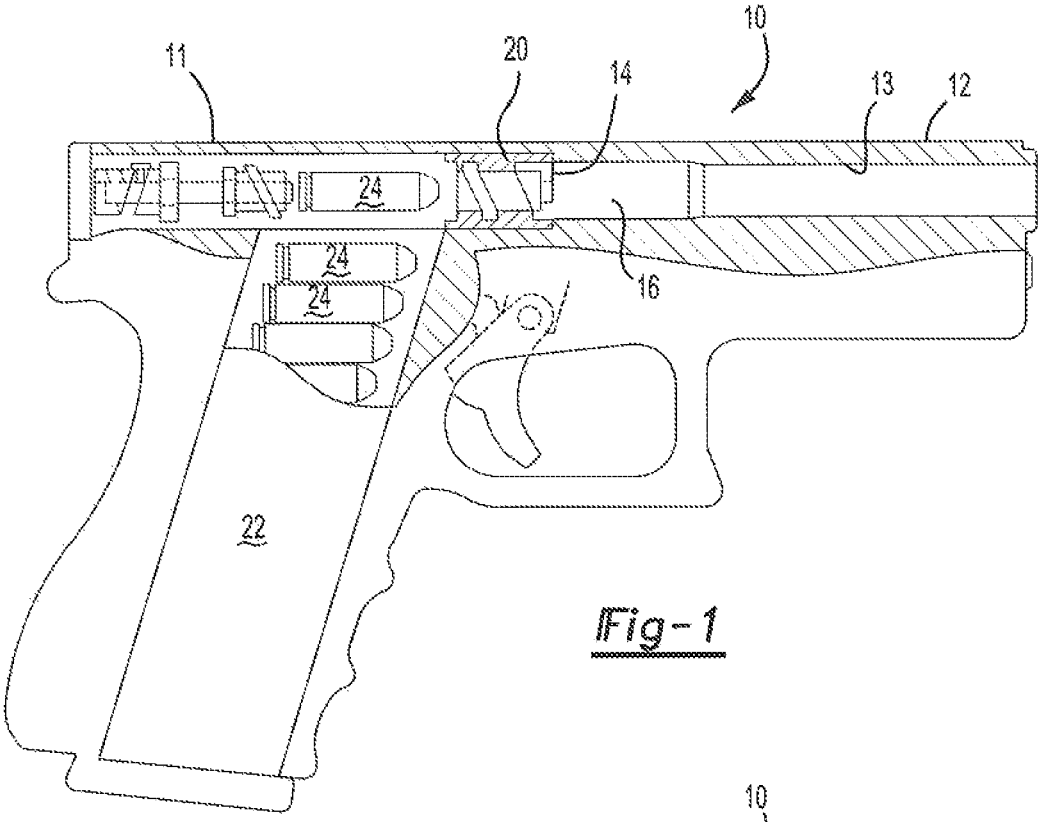
FIG. 1 is a partial sectional view showing an automatic gun in its loading position.
Figure 2:
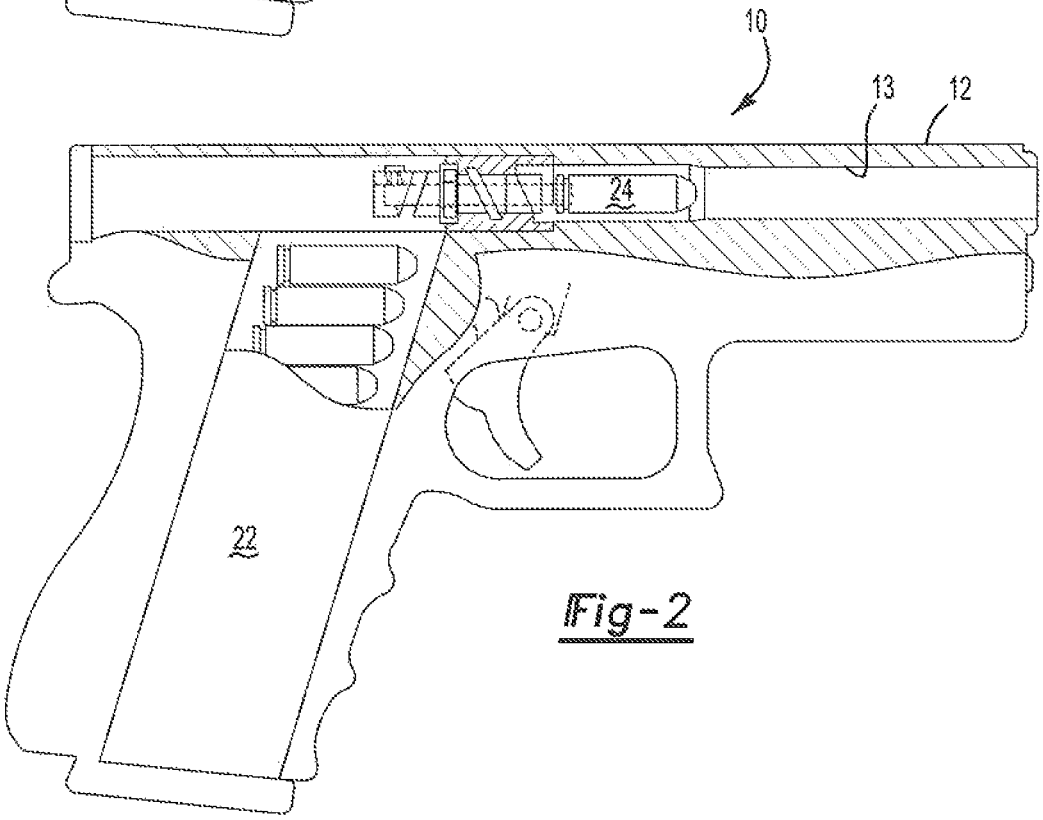
FIG. 2 is a partial sectional view of the gun in its firing position.

With reference first to FIGS. 1 and 2, a typical semiautomatic or automatic gun 10 is shown. The gun 10 includes a body 11 having an elongated barrel 12 with a bore 13 having barrel extension 20 at its rear end 14. The barrel extension 20 forms a breech 16 which receives a cartridge 24 to be fired.

A bolt 18 is reciprocally mounted to the gun body 11 between a retracted loading position, shown in FIG. 1, and an extended firing position, shown in FIG. 2. In its loading position, the bolt 18 is retracted from the barrel extension 20 while in its firing position the bolt 18 extends through the barrel extension 20 and supports the cartridge 24 loaded into the breech 16.

An ammunition magazine 22 typically contains one or more cartridges 24. In the conventional fashion, upon firing of the automatic gun 10, the bolt 18 and barrel extension 20 retract rearwardly to the loading position (FIG. 1). This rearward retraction enables ejection of the spent casing and also allows one cartridge 24 from the magazine 22 to move in front of the bolt 18 and behind the barrel extension 20. The subsequent forward movement of the bolt 18 to its firing position loads the cartridge into the breech 16 in preparation for firing.

Figure 3:
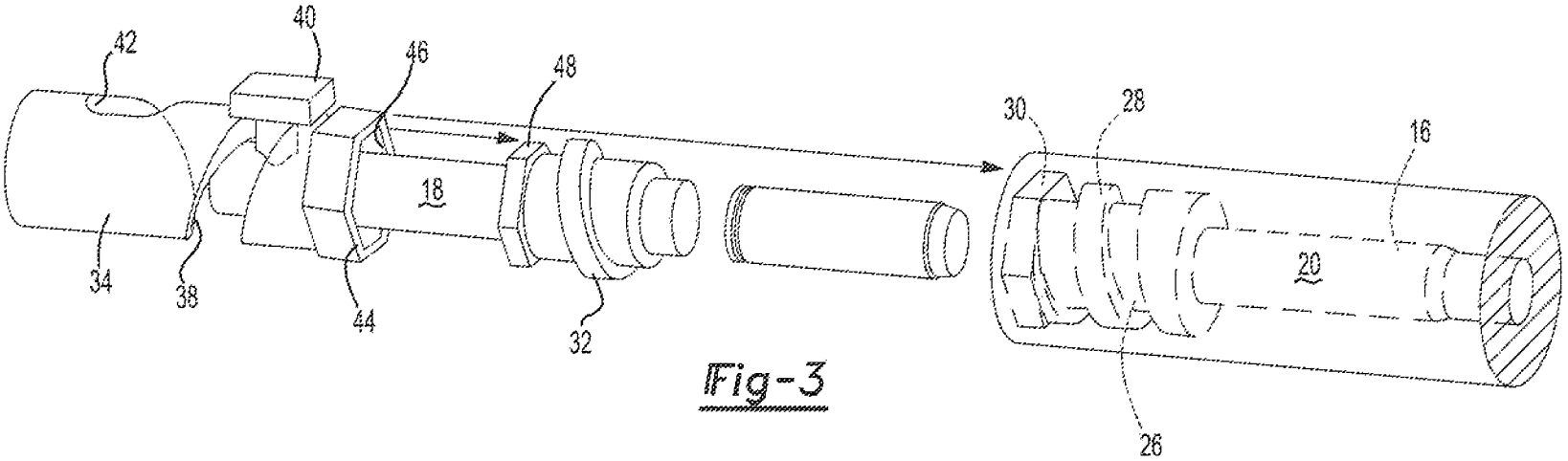
FIG. 3 is an exploded view of the breech assembly in its loading position and with parts removed for clarity; and similar to FIG. 2, but showing the bolt retracted from the barrel extension.
Figure 4:
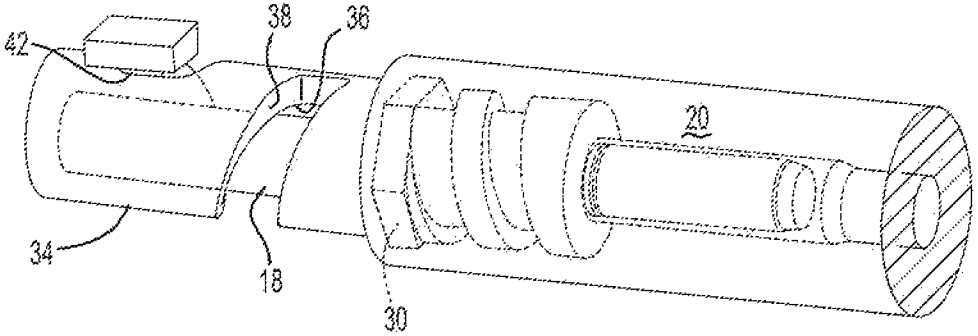
FIG. 4 is a view similar to FIG. 3, but showing the breech assembly in its firing position.

With reference now to FIGS. 3 and 4, the bolt 18 and barrel extension 20 are there shown in greater detail. In particular, the barrel extension 20 includes a throughbore 26 which is aligned with and open to the breech 16. This throughbore 26 is circular in cross section and includes an internal spiral thread 28. Preferably, the spiral thread 28 is dimensioned so that the thread 28 only exhibits a single turn within the barrel extension 20.

A non-circular locking recess 30 is formed at the rear open end of the barrel extension 28, i.e. the end of the barrel extension 28 opposite from the barrel 12. This locking recess 30 is illustrated in FIGS. 3 and 4 as being hexagonal in shape although any other polygon, and indeed any other non-circular shape, may be alternatively used.

Still referring to FIGS. 3 and 4, the bolt 18 is elongated and generally circular in cross-sectional shape. An external thread 32 is formed at the forward end of the bolt 18. This thread 32, furthermore, is complementary in both size and pitch to the internal thread 28. As such, the bolt 18 is capable of threadably engaging the barrel extension 20 and is movable between a retracted or loading position, illustrated in FIG. 3, and a firing position, illustrated in FIG. 4. In its loading position, the bolt 18 is removed from the barrel extension 20 to enable a new cartridge 24 to be loaded behind the barrel extension 20. Conversely, with the bolt 18 in its firing position shown in FIG. 4, the bolt 18 abuts against the rear of the cartridge 24 when loaded into the breech.

In order to both longitudinally displace the bolt 18 and simultaneously rotate the bolt 18 during that displacement, a bolt carrier 34 is disposed around the bolt 18 and includes a cylindrical cavity 36 dimensioned to slidably receive the bolt 18. A spiral slot 38 is formed through the bolt carrier 34 from adjacent the forward end of the bolt carrier 34 to adjacent the rear end of the bolt carrier 34. This slot 38, furthermore, extends for substantially one turn.

A cam pin 40 is secured to the bolt 18 so that the cam pin 40 moves in unison with the bolt 18. The cam pin 40 is positioned through the spiral slot 38 on the bolt carrier 34. Consequently, longitudinal displacement of the bolt carrier 34 both longitudinally and rotatably drives the bolt 18 due to the frictional coaction between the cam pin 40 and the spiral slot 38. The rotary drive of the bolt 18 caused by the longitudinal movement of the bolt carrier 34 also allows the bolt 18 to longitudinally displace between its retracted loading position (FIG. 3) and its firing position (FIG. 4).

A longitudinally or axially extending notch 42 is formed at the rear end of the spiral slot 38 on the bolt carrier 34. Thus, when the bolt 18 is moved to its forward position and the cam pin reaches the rear end of the spiral slot 38, a small additional forward movement of the bolt carrier 34 relative to the bolt 18 occurs. This small forward movement permitted by the notch 42 serves two purposes. First, the forward movement of the bolt 18 permits a locking member 44 attached to the bolt earner 34 to shift forwardly into the locking recess 30 formed on the barrel extension 20. Consequently, with the locking member 44 positioned within the locking recess 30, the bolt carrier 34 is locked against rotation relative to the barrel extension 20, at least until the bolt carrier is retracted away from the barrel extension 20.

Secondly, the forward displacement of the bolt carrier enabled by the notch 42 at the end of the spiral slot 38 also allows the locking member 44, which has a non-circular inner recess 46, to slide over a bolt locking member 48 attached to or formed on the bolt 18. The bolt locking member 48 has an outer periphery complementary to and of the same size as the recess 46 on the locking member 44. Consequently, as the locking member 44 slides over the secondary locking member 48, the interaction between the locking member 44 and the bolt locking member 48 locks the bolt carrier 34 and bolt 18 together against rotation relative to each other.

In operation the bolt 18 and bolt carrier 34 reciprocate between the loading and firing positions for each round fired. Furthermore, the bolt 18 is firmly locked to both the barrel extension 20 and the bolt carrier 34 when each round is fired.

From the foregoing, it can be seen that the present invention provides a breech assembly for an automatic and semiautomatic gun having a continuous thread 32 on the bolt 18 and corresponding thread 26 on the barrel extension 20 which provides a 100% load bearing support as the cartridge is fired. Since this load bearing support is at least double the load bearing support of the previously known small arms, the overall size of the barrel extension 20 and bolt 18 may be reduced without sacrificing the load bearing support or safety when firing the gun.

Having described my invention, many modifications thereto will become apparent to those skilled in the art to which it pertains without deviation from the spirit of the invention as defined by the scope of the appended claims.

I claim:

1. A breech assembly for a semiautomatic or automatic gun comprising:

a breech which receives a cartridge, a barrel extension aligned with and extending outwardly from said breech, said barrel extension having a throughbore aligned with said breech and an internal thread, an elongated bolt having an uninterrupted external thread complementary to said internal thread in said barrel extension bore, a bolt carrier longitudinally slidably mounted and locked against rotation to said barrel extension, said bolt carrier being connected to said bolt to longitudinally displace said bolt in unison with said bolt carrier but permit rotation of said bolt relative to said bolt carrier; and wherein said bolt carrier has a locking member at one end complementary in shape to a locking recess formed at a rear end of said barrel extension, so that, with said bolt threaded into said barrel extension and said locking nested in said locking recess, said bolt carrier prevents rotation of said bolt; and wherein said locking member is polygonal in cross-sectional shape.

2. The breech assembly as defined in claim 1 wherein said barrel extension thread is substantially a single turn thread so that said bolt rotates substantially one rotation between a loading position in which said bolt is retracted from said barrel extension and firing position in which said bolt is positioned in said barrel extension behind a cartridge and in position to fire the cartridge.

3. The breech assembly as defined in claim 1, wherein said locking member is hexagonal in cross-sectional shape.

* * * * *